United States Patent [19]

Hahn

[11] 4,053,569

[45] Oct. 11, 1977

[54] UPGRADING COAL FOR COKING PURPOSES

[76] Inventor: Hans Helmut Hahn, 38 Marais St., Bailey's Muckleneuk, Pretoria, South Africa

[21] Appl. No.: 696,221

[22] Filed: June 15, 1976

[30] Foreign Application Priority Data

June 20, 1975 South Africa ..... 75/3956

[51] Int. Cl.[2] ..... C01B 31/02; C01C 1/00; C10B 53/04; C10B 55/02

[52] U.S. Cl. ..... 423/445; 44/1 F; 44/23; 106/273 R; 106/284; 201/21; 201/23; 208/22; 423/449

[58] Field of Search ..... 201/5, 6, 9, 21, 23; 48/206; 44/1 B, 1 F, 23, 24, 25; 208/22; 106/273 R, 284; 423/445, 449

[56] References Cited

U.S. PATENT DOCUMENTS

| | | | |
|---|---|---|---|
| 2,686,152 | 8/1954 | Franke | 201/20 X |
| 3,403,989 | 10/1968 | Blake et al. | 44/23 |
| 3,540,867 | 11/1970 | Baron et al. | 48/206 X |

FOREIGN PATENT DOCUMENTS

| | | | |
|---|---|---|---|
| 1,260,034 | 1/1972 | United Kingdom | 201/23 |

*Primary Examiner*—Joseph Scovronek
*Attorney, Agent, or Firm*—Millen & White

[57] ABSTRACT

The invention relates to the upgrading of coal for coking purposes and improved cokes resulting from such upgrading. Pitch obtained as a by-product of pressure-gasification (Lurgi-process) is used as an additive either alone or blended with SRC. The additive is employed in amounts of 1% and 50% by mass, preferably 5 to 15% of the total blend. The additive preferably has an R-and-B softening temperature above 80° C. The additive can be subjected to various treatments, e.g. heating in presence of hydrogen, to improve its characteristics.

12 Claims, No Drawings

UPGRADING COAL FOR COKING PURPOSES

BACKGROUND OF THE INVENTION

The present invention relates to improvements in carbonaceous materials, and in particular to the making of coke, e.g. metallurgical coke from coal having unsatisfactory coking properties.

Coke is an important raw material for metallurgical processes, in particular for use in blade furnaces. There exists a growing shortage of coal suitable for coke-making (so-called coking coals).

It is already known to produce coking blends from coal having unsatisfactory coking properties by blending such coal with materials adapted to improve these qualities, e.g. superior coking coals. Solvent-refined coal has also been suggested for coking purposes, but this material is rather expensive (see U.S. Pat. No. 2,686,152).

U.S. Pat. No. 1,925,005 describes a process for enriching the coking constituents of coke by selective dissolving.

Pressure gasification of coal (also known as Lurgi-pressure gasification) is a process wherein coal, e.g. black coal or brown coal is reacted with oxygen and steam under pressure to produce a mixture of carbon monoxide and hydrogen and carbon dioxide. The process also yields a low temperature tar, the components of which range from highly volatile substances to pitch. Pitch in this context is substantially the tar residue composed of substances mostly boiling from about 300° C upwards, although the commercial pitch may still contain traces of substances boiling between 270° C and 300° C. This pitch may be used in the manufacture of certain grades of epoxy resin compositions, as a component of road tar and of creosote. It is sometimes considered a waste product for which no adequate use exists.

This pitch differs in many respects from pitch derived from various carbonisation processes, in particular from conventional coking processes. Inter alia the chemical compositions differ substantially since pressure-gasification tar contains numerous compounds which are not known to exist in coke-oven tar, and the relative proportions of common ingredients are different.

The present invention is based on the surprising realisation that the higher boiling tar constituents of the aforesaid pressure gasification products, in particular the pitch fraction, if incorporated in a coking blend, e.g. together with certain coals which cannot alone be used satisfactorily as good coking coals, will result in a blend having improved coking properties as compared with the said coals as such. The effects observed differ remarkably from those observable with coke-oven pitch and entail surprising advantages.

However, the invention can also be used to further improve the coking characteristics of coal or coal blends which already have reasonable coking characteristics.

Further objects and uses of the invention will appear from the following description.

SUMMARY OF THE INVENTION

In accordance with the invention there is provided a method of upgrading coal for coking purposes which comprises blending said coal with more than 1 and less than 50% by weight (mass) based on the total blend of an additive comprising a pitch-like high-boiling fraction or distillation residue of a tar formed as a by-product of the pressure-gasification of coal in the presence of steam and oxygen to yield a gas comprising carbon monoxide, hydrogen and carbon dioxide.

The resulting upgraded coking blend is considered a novel product.

The invention also provides as a new or improved product a coke, being the product of carbonisation of a blend of between 50 and 99% by weight (mass) of coal and between 1 and 50% by weight (mass) of an additive comprising a pitch-like, high-boiling fraction or distillation residue of a tar formed as a by-product of the pressure-gasification of coal in the presence of steam and oxygen to yield a gas comprising carbon monoxide, hydrogen and carbon dioxide.

According to a further aspect of the invention there is provided an additive for upgrading coal for coking purposes which comprises from 30 to 100% by weight (mass) of a pitch-like, high-boiling fraction or distillation residue of a tar formed as a by-product of the pressure-gasification of coal in the presence of steam and oxygen to yield a gas comprising carbon monoxide, hydrogen and carbon dioxide, said fraction or residue having been heat-treated to yield a ring-and-ball softening point of not less than 100° C, and from 0 to 70% by weight (mass) of SRC.

The invention further envisages a coke-making process which comprises blending between 99 and 50 percent by weight (mass) of a suitable coal and between 1 and 50% by weight (mass) of an additive of which at least 30% by weight (mass) is a pitch-like high boiling fraction or distillation residue of a tar formed as a by-product of the pressure-gasification of coal in the presence of steam and oxygen to yield a gas comprising carbon monoxide, hydrogen and carbon dioxide and between 0 and 70% by weight (mass) of SRC, and subjecting the resulting blend to carbonisation in a coke-making apparatus.

DETAILED DESCRIPTION

The aforegoing different aspects all relate to or are directed to the preparation of coke from coal having unsatisfactory or not completely satisfactory coking properties by blending such coal with a high boiling fraction or distillation residue of a coal pressure-gasification tar and subjecting the blend to coking conditions.

In the preferred embodiments the additive is employed in amounts of less than 30% by weight (mass) e.g. between 2 and 20%, more particularly 5 to 15%, say about 10% of the total blend.

The additive may be composed entirely of said pitch-like fraction or residue or it may be a blend, e.g. produced by blending between 90 and 30% of said pitch-like fraction with between 10 and 70% of SRC, preferably not more than 50% of SRC. (SRC = "solvent-refined coal"). In either case it is preferred to incorporate said pitch-like fraction in the coal blend in amounts of between 2 and 15% by weight (mass) based on the total blend.

Ordinary commercial pitch derived from pressure-gasification plants usually has a ring-and-ball softening point below 80° C.

In accordance with preferred embodiments of the present invention additional improvements are attained if instead of such ordinary commercial pitch fraction of pressure gasification tar there is employed a pitch-like fraction of such pressure gasification tar having a ring-and-ball softening point in excess of 80° C, preferably a ring-and-ball softening point of not less than 100° C, e.g. between 100° and 160° C, say 105° C.

To attain this higher softening point, the pitch-like fraction may be appropriately heat-treated. Such heat treatment may involve distillation to remove more of the lower-boiling ingredients and/or heating above the temperature of free radical formation and recombination but below a temperature at which thermal cracking predominates.

The heat treatment may also involve the addition of cross-linking agent(s), e.g. epoxy resin, say in amounts of between 1 and 10% by weight.

Further advantages may be attained by carrying out all or part of said heat treatment at between 300° and 500° C for not less than 10 minutes, e.g. for 15 to 200 minutes, preferably between 20 and 60 minutes in contact with hydrogen at a partial pressure of several bars, e.g. between 20 and 150 bars, the combination of parameters being selected to favour non-destructive hydrogenation.

The temperature, partial pressure of hydrogen and heating time may be so matched that simultaneously with said non-destructive hydrogenation there takes place an increase in softening temperature.

The hydrogenation may take place in the presence of catalyst or without catalysts, preferably without. This hydrogenation may serve to further lower the oxygen and/or sulphur content of the pitch.

The coal component of the blend is preferably selected from coals having a certain degree of coking properties, but not measuring up the required standard for a satisfactory coking coal.

Surprisingly the invention produces particularly favourable results when applied to coal mixtures composed of poor coking coal and a certain percentage, normally less than 50% by weight of a coal which alone yields a satisfactory coke. The poor coking coal may represent as much as 90% by weight of the coal mixture, the balance being a coal which alone yields a satisfactory coke. The incorporation of a small percentage of the superior coal in some way or another enhances the beneficial effect of the additive in accordance with the invention.

Coking may be carried out substantially in a manner known per se. This aspect requires no description.

The effect of the addition of the said coal fraction or pitch may be in many respects similar to that experienced if solvent-refined coal is blended with coal.

However, there are also often distinct differences, which differences may be diminished by the said step of heating in the presence of hydrogen.

It is also observed that the characteristics of the said pitch and of SRC are sometimes supplementary, wherefore blending of these components can result in an advantageous additive.

The scope of the present invention extends to the use of coke manufactured in accordance with the invention for metallurgical processes.

DESCRIPTION OF SPECIFIC EMBODIMENTS

EXAMPLE 1

Preparation of additives a. A non-caking high-ash black coal (Sasolburg, Orange Free State, South Africa) is subjected to conventional Lurgi-pressure gasification on a commercial scale at an average generator temperature of between about 350° and 400° C. The gasification products are passed successively through a conventional system of coolers to separate from the gas the following liquid products: Tar (b.p. above 93° C) and oil (b.p. 27° - 93° C).

The tar and oil are recombined and subjected to fractional distillation to yield "tar oils" and "creosotes" and pitch as residue having a ring-and-ball softening point of 68° C (RB 68). RB 68 represents the commercial grade of pitch from this process.

RB 68 has the following analysis:

C : 83.8 mass %; H : 6.4 mass %; N 1.4 mass %; S : 0.3 mass %; 0 : 5.5 mass %; ash 2.6 mass %

Its volatile content (determined by vacuum distillation) is as follows:

b.p. up to 270° C 0 mass % b.p. up to 300° C 0.6 mass % b.p. up to 350° C 3.0 mass % b. Commercial grade pitch as aforesaid is subjected to further distillation under vacuum (5 mm Hg) until the temperature of the distillate has reached 150° C. This takes place over a period of 30 minutes, during which the temperature of the distillation vessel reaches approximately 170° C. This heat treatment yields a residual pitch (RB105) having a ring-and-ball softening point of 105° C.

c. In the light of favourable results from this distillation it is preferred to continue the vacuum distillation to higher temperatures, e.g. up to 200° C.

d. Similar favourable results are attained by steam distillation instead of vacuum distillation.

EXAMPLE 2

Coking blends and tests

The following South African coals and coal blends are tested alone and after blending with the additives described in Example 1: (0%, 5%, 10% by mass of additive based on total blend):

Landau coal: a weakly coking South African coal, considered too poor for satisfactory coking.

DNC coal: (Durban Natal Collieries) a satisfactory South African coking coal of which available reserves are dwindling.

70% Landau + 30% DNC: a blend as used commercially by South African steel works.

85% Landau + 15% DNC: a blend too poor by present standards.

The coal was ground in the usual manner, mixed with the stated amounts of additives and subjected to the Roga test, the swelling test and the dilatometer test. The results are summarised in Table 1.

The following is apparent from the table:

1. The best results are attained if the coal sample contains at least some, albeit a minor proportion of good coking coal (e.g. DNC);

2. The pitch treated to a higher ring-and-ball softening point (RB 105) is clearly superior.

EXAMPLE 3

A blend is prepared of 15% pressure gasification pitch (black coal) treated as in Example 1 to reach a ring-and-ball softening point of 118, 10% DNC coal and 75% Landau coal. The blend is subjected to coking under conventional coking conditions in an experimental coke oven. A coke, satisfactory for iron-smelting is obtained.

EXAMPLE 4

Commercial pressure gasification pitch (Example 1 RB 68) is heated to 420° C in an autoclave containing a nitrogen atmosphere at 2 bar pressure. When the temperature has reached 400° C, hydrogen is introduced to raise the pressure to 70 bar. The temperature of 420° C is maintained for 40 minutes. After releasing the pressure, the contents of the autoclave are distilled under vacuum (30 mm Hg) to yield as a residue a pitch having a ring-and-ball softening temperature of 120° C suitable as a coking additive.

10 - 15% of the additive blended with 90 - 85% Landau coal yields a satisfactory coking blend.

EXAMPLE 5

Example 4 is repeated with a pressure gasification pitch obtained from the Lurgi-pressure gasification of brown coal.

EXAMPLE 6

Pressure gasification pitch obtained from the Lurgi-pressure gasification of brown coal is directly distilled under vacuum to yield a pitch having a ring-and-ball softening temperature of 110° C. The pitch has similar characteristics as a coking additive to the pitch RB 105 in accordance with Examples 1 and 2.

EXAMPLE 7

60% pitch RB 105 (Example 1) are blended with 40% SRC prepared as described in South African Pat. No. 74/3325 (German Offenlegungsschrift No. P 25, 22, 772.9) from a low-ash brown coal. 10% by mass of the blend mixed with 90% Landau coal yields on coking a coke useful for iron smelting. Superior results are attained when using 10% of the blended additive, 10% of DNC coal and 80% of Landau coal.

EXAMPLE 8

3% epoxy resin are mixed thoroughly with 97% pitch RB 68 (Example) at 100° C. The mixture is then distilled under vacuum until the residual pitch has a ring-and-ball softening temperature of 130° C. The thus modified pressure-gasification pitch can be used as a coking additive.

EXAMPLE 9

The procedure of Example 4 is repeated using (a) gas from the pressure-gasification; (b) the same gas enriched in hydrogen. In both cases the hydrogen partial pressure is not less than 50 bar.

TABLE 1

| Coal used | LANDAU (73/473) | | | | | DNC (73/503) | | | | |
|---|---|---|---|---|---|---|---|---|---|---|
| | | 5% RB68 | 10% RB68 | 5% RB105 | 10% RB105 | 0 | 5% RB68 | 10% RB68 | 5% RB105 | 10% RB105 |
| Swelling No. | 2 | 2½ | 2½ | 3 | 2½ | 5½ | 5½ | 5 | 5 | 5 |
| Roga Index | 31 | 28 | 31 | 31 | 34 | 55 | 58 | 58 | 53 | 52 |
| Dilatometer | | | | | | | | | | |
| Contraction % | 18% | 17% | 18% | 17% | 13% | 7% | 11% | 11% | 17% | 11% |
| Dilatation % | −18% | −17% | −18% | −17% | −13% | +9% | 43% | 80% | 50% | 108% |
| Dil. Ampl. % | 0% | 0% | 0% | 0% | 0% | 16% | 54% | 91% | 67% | 119% |

| Coal used | 30% DNC+70% LANDAU | | | 15% DNC+85% LANDAU | | |
|---|---|---|---|---|---|---|
| Additive | 0 | 10% RB105 | 10% RB68 | 0 | 10% RB68 | 10% RB105 |
| Swelling No. | 3½ | 4½ | 3½ | 2½ | 3 | 3½ |
| Roga Index | 38 | 40 | 40 | 31 | 34 | 37 |
| Dilatometer | | | | | | |
| Contraction % | 18% | 12% | 11% | 16 | 14 | 16 |
| Dilatation % | −18% | −3% | −6% | −16 | −14 | −13 |
| Dil. Ampl. % | 0% | 9% | +5% | 0 | 0 | +3 |

What is claimed is:

1. Method of upgrading coal for coking purposes which comprises blending said coal with more than 1 and less than 50% by weight (mass) based on the total blend of an additive comprising a pitch-like high-boiling fraction or distillation residue boiling above 270° C of a tar formed as a by-product of the pressure-gasification of coal in the presence of steam and oxygen to yield a gas comprising carbon monoxide, hydrogen and carbon dioxide.

2. Method as claimed in claim 1 which comprises thus blending with between 2 and 20% of the additive, by weight (mass) based on the total blend.

3. Method as claimed in claim 1 which comprises thus blending with between 2 and 15% by weight (mass) based on the total blend of said pitch-like fraction.

4. Method as claimed in claim 1, wherein said pitch-like fraction has a ring-and-ball softening point in excess of 80° C.

5. Method as claimed in claim 1, wherein said pitch-like fraction has a ring-and-ball softening point of not less than 100° C.

6. Method as claimed in claim 1, wherein the additive is produced by blending between 90 and 30% of said pitch-like fraction with between 10 and 70% of SRC.

7. Method as claimed in claim 1, wherein the coal is a mixture of up to 90 percent by weight of poor coking coal, the balance being a coal which alone yields a satisfactory coke.

8. Method as claimed in claim 1, followed by a step of carbonisation under coke-oven conditions and the recovery of coke.

9. Coke, being the product of carbonisation under coke-oven conditions of a blend of between 50 and 99% by weight (mass) of coal and between 1 and 50% by weight (mass)of an additive comprising a pitch-like, high-boiling fraction or distillation residue boiling above 270° C of a tar formed as a by-product of the pressure-gasification of coal in the presence of steam and oxygen to yield a gas comprising carbon monoxide, hydrogen and carbon dioxide.

10. An additive for upgrading coal for coking purposes which comprises from 30 to 100% by weight (mass) of a pitch-like, high-boiling fraction or distillation residue boiling above 270° C of a tar formed as a by-product of the pressure-gasification of coal in the presence of steam and oxygen to yield a gas comprising carbon monoxide, hydrogen and carbon dioxide, said fraction or residue having been heat-treated to yield a ring-and-ball softening point of not less than 100° C, and from 0 to 70% by weight (mass) of SRC.

11. Method as claimed in claim 1, wherein the pitch-like fraction prior to said blending is heated in contact with hydrogen at a partial pressure of several bars at between 300° and 500° C for not less than 10 minutes.

12. A coke making process which comprises blending between 99 and 50 percent by weight (mass) of a suitable coal and between 1 and 50% by weight (mass) of an additive of which at least 30% by weight (mass) is a pitch-like, high-boiling fraction or distillation residue boiling above 270° C of a tar formed as a by-product of the pressure-gasification of coal in the presence of steam and oxygen to yield a gas comprising carbon monoxide, hydrogen and carbon dioxide and between 0 and 70% by weight (mass) of SRC, and subjecting the resulting blend to carbonisation in a coke-making apparatus.

* * * * *